United States Patent [19]

Foerst

[11] 4,324,166

[45] Apr. 13, 1982

[54] TUNING DEVICE FOR MUSICAL INSTRUMENTS

[75] Inventor: Reiner Foerst, Gummersbach, Fed. Rep. of Germany

[73] Assignee: Dr.-Ing. Reiner Foerst GmbH, Gummersbach, Fed. Rep. of Germany

[21] Appl. No.: 119,435

[22] Filed: Feb. 7, 1980

[30] Foreign Application Priority Data

Feb. 9, 1979 [DE] Fed. Rep. of Germany ..... 2904912

[51] Int. Cl.[3] ..... G10G 7/02

[52] U.S. Cl. ..... 84/454; 84/DIG. 18; 324/78 R

[58] Field of Search ..... 84/454, 455, 958, DIG. 18; 324/78 R, 78 Q, 79 D

[56] References Cited

U.S. PATENT DOCUMENTS 3,280,937 10/1966 Faber ..... 324/79 D 3,948,140 4/1976 Ichioka ..... 84/454

4,205,584 6/1980 Foerst ..... 84/454

*Primary Examiner*—L. T. Hix

*Assistant Examiner*—Stafford D. Schreyer

*Attorney, Agent, or Firm*—Becker & Becker, Inc.

[57] ABSTRACT

A tuning device for musical instruments including a high frequency oscillator having frequency controlled by a tone select switch and an octave select switch and the output $S_H$ of which is supplied to the input of an AND-gate, the output of which is supplied to the display device for the tone pitch and the other input of which is connected to the output of a reference time signal generator which comprises a flip-flop for a wait signal $S_W$ and which is started by the amplitude of the tone via a microphone, an amplifier, a filter, a smoothing device and a Schmitt-trigger, and which is stopped after the counting of a definite number of tone oscillations filtered and converted into rectangular pulses. The opening time of the gate is preset by external oscillation with an internal oscillation, the frequency of which is started depending upon the frequency of the tone to be measured. The constant measuring accuracy being independent from the tone and enabling also a tuning deviating from standard pitch are features provided as advantages along with a further advantage of short measuring time with good accuracy which is inherent to the period measuring method being additionally gained.

1 Claim, 1 Drawing Figure

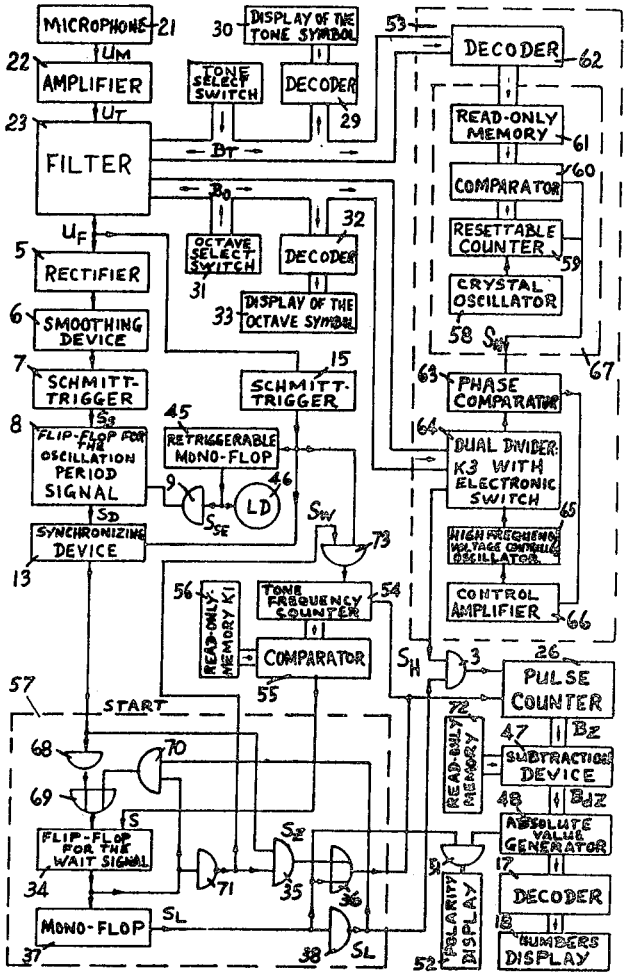

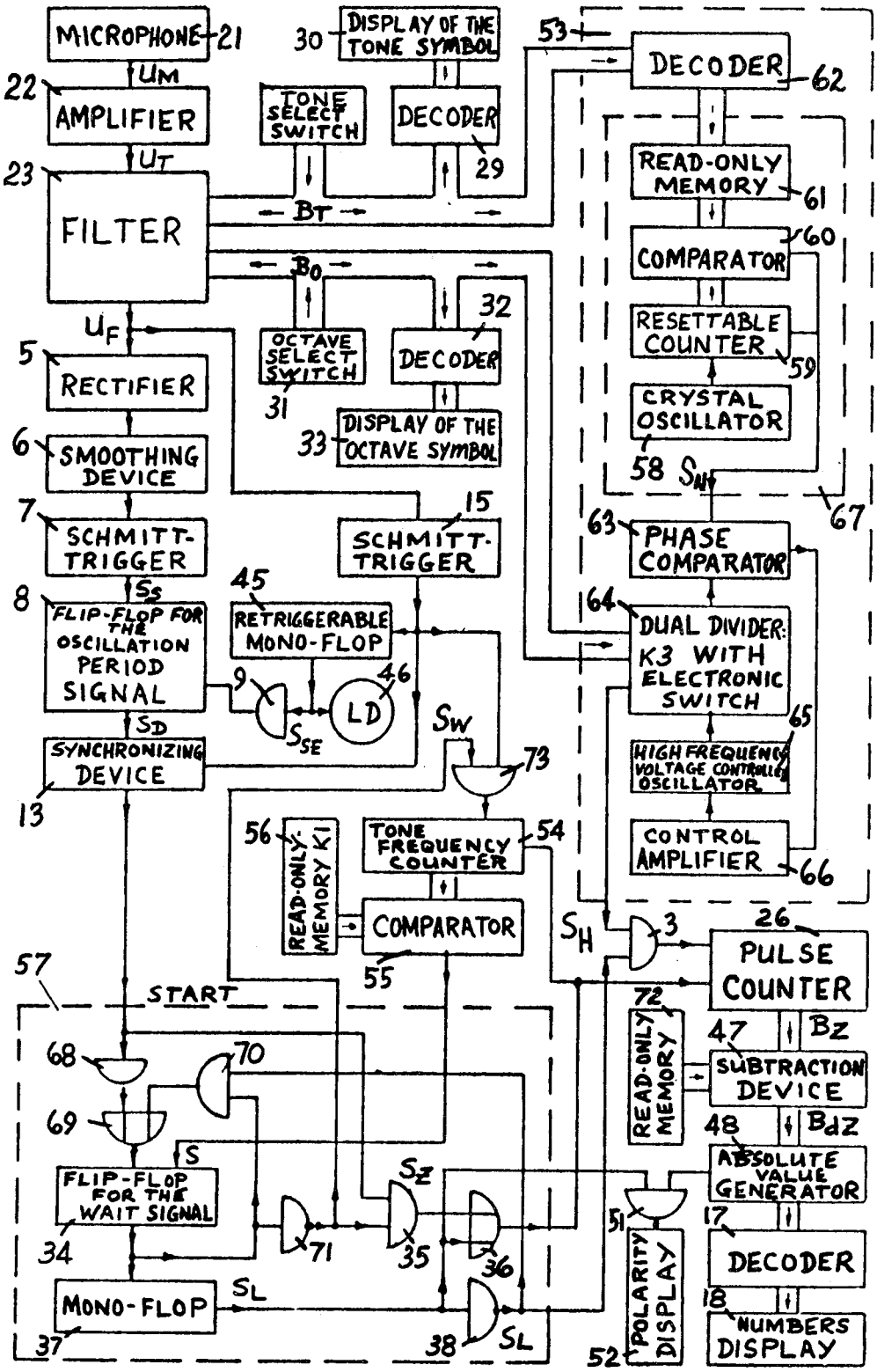
MICROPHONE
21
UM
22
AMPLIFIER
UT
23
FILTER
BT
BO
UF
5
RECTIFIER
6
SMOOTHING DEVICE
7
SCHMITT-TRIGGER
SS
8
FLIP-FLOP FOR THE OSCILLATION PERIOD SIGNAL
SD
SYNCHRONIZING DEVICE
13
30
DISPLAY OF THE TONE SYMBOL
TONE SELECT SWITCH
DECODER
29
OCTAVE SELECT SWITCH
31
32
DECODER
33
DISPLAY OF THE OCTAVE SYMBOL
15
SCHMITT-TRIGGER
45
RETRIGGERABLE MONO-FLOP
9
46
LD
SSE
SW
73
56
READ-ONLY MEMORY K1
TONE FREQUENCY COUNTER
54
COMPARATOR
55
57
START
68
69
70
S
FLIP-FLOP FOR THE WAIT SIGNAL
34
71
SZ
35
36
MONO-FLOP
SL
37
38
SL
53
DECODER
62
READ-ONLY MEMORY
61
COMPARATOR
60
RESETTABLE COUNTER
59
CRYSTAL OSCILLATOR
58
SH
67
63
PHASE COMPARATOR
64
DUAL DIVIDER: K3 WITH ELECTRONIC SWITCH
65
HIGH FREQUENCY VOLTAGE CONTROLLED OSCILLATOR
CONTROL AMPLIFIER
66
SH
3
26
PULSE COUNTER
72
READ-ONLY MEMORY
47
BZ
SUBTRACTION DEVICE
48
BdZ
ABSOLUTE VALUE GENERATOR
51
POLARITY DISPLAY
52
17
DECODER
18
NUMBERS DISPLAY

TUNING DEVICE FOR MUSICAL INSTRUMENTS

The present invention relates to a tuning device for musical instruments including a microphone, an amplifier, a filter for the prevention of zero transits or zero crossovers extraneous to the fundamental tone oscillation, a Schmitt-trigger for the conversion of the filtered tone frequency voltage into a digital oscillation signal and an impulse counter with decoder and a display device for digits.

Tuning devices of the above-mentioned kind or similar devices are already known.

In the U.S. Pat. No. 4,205,585-Foerst issued June 3, 1980, entitled "Tuning Device for Musical Instruments", a device is described including two mono-flops for the conversion of the digital tone oscillation signal into a zero transit or zero crossover signal, a flip-flop for the oscillation period signal which is set via the combination of a rectifier, a smoothing device, and a Schmitt-trigger by the increasing amplitude of the filtered tone frequency voltage and which is reset by an inverted oscillation existence signal, comprising therewith a synchronizing device, a reference frequency source, a reference pulse counter, and an oscillation counter to which the zero transit signal is supplied via an AND-gate.

In the U.S. Pat. No. 4,253,373-Foerst issued Mar. 3, 1981, entitled "Tuning Device for Musical Instruments", a device is described comprising, as an improvement and further development of the above-mentioned application, a tone store in which the values for the tone cycle lengths are stored, and which is addressable from a tone select switch via a decoder, and also comprising therewith a comparator supplying a counting period end signal when the output of the reference pulse counter and the stored cycle length value are equal.

In the two above-mentioned patent applications, a tuning device for musical instruments is described in which the reference period, during which the gate for the external oscillation to be counted is opened, is preset internally. To keep the unavoidable plus-minus-1-error small, with this principle a sufficiently large number of periods or half-periods must be counted. The disadvantage of this principle is therefore at low frequencies the relatively long measuring time.

U.S. Pat. Nos. 3,144,802-Faber et al issued Aug. 18, 1964, entitled "Tuning Apparatus", 3,948,140-Ichioka et al issued Apr. 6, 1976, entitled "Portable Device for Generating and Tuning a Whole Tone Scale", and 1,213,794 issued Jan. 23, 1917, entitled "Tuning of Musical Instruments" are mentioned in the specification of U.S. Pat. No. 4,253,373-Foerst "Tuning Device for Musical Instruments" and the respective disadvantages thereof are indicated.

Therefore, it is an object of the present invention to provide a device with which a comparing table is unnecessary and with which in a simple manner tones of any frequency can be measured with equal and high accuracy with a short measuring time and with an easily readable display.

The basic idea of the present invention is to invert the principle of the U.S. Pat. No. 4,253,373-Foerst, with which the opening time of the gate was preset internally depending upon the frequency of the correct tone to be measured and with which the external oscillation was counted, in such a manner that the opening time of the gate is preset by the external oscillation, and an internal oscillation, the frequency of which depending upon the frequency of the correct tone to be measured, is counted. Accordingly, the constant measuring accuracy being independent from the tone and enabling also a tuning deviating from standard pitch are features maintained as advantages, and the advantage of the short measuring time with good accuracy which is inherent to the period measuring method is additionally gained.

A further object of the present invention is to disclose an economical and accurate solution for the generation of the internal tonepitch-dependent oscillation by the use of a commercial 12-tone oscillator in combination with a phase-locked oscillator, the generating frequency thereof being at a measuring range of 6 octaves by at least 6 powers of two higher than its reference frequency.

A further idea of the present invention is to use the advantage of the short measuring time especially with long oscillating tones and to repeat the display after its vanishing using the display logic for which a patent is already pending. Accordingly, also changes in frequency during the fading out or decaying of a tone can be displayed.

These and other objects and advantages of the present invention, will appear more clearly from the following specification in connection with the accompanying drawing.

The FIGURE of the drawing illustrates a block diagram to show features of the present invention.

Referring now to the drawing in detail the invention may now be described using the drawing which is in the form of a block diagram. The drawing includes many devices of the U.S. Pat. Nos. 4,205,585-Foerst and 4,253,373-Foerst. Therefore, description of these devices may here be considered unnecessary now though incorporation of these disclosures for the features thereof is made by reference thereto.

In the block diagram, a high frequency reference oscillator 53 is provided which comprises several subordinate blocks and which supplies the high frequency reference signal $S_H$ to the AND-gate 3. The frequency of this signal is higher by the factor K3 than the reference frequency of the tone to be tuned in standard pitch. The 12 reference tones of the highest octave to be tuned are preset via the tone select switch 28 by the tone byte $B_T$. The octaves are preset via the octave select switch 31 by the octave byte $B_O$.

In the block diagram, furthermore a reference time signal generator 57 is provided which includes several subordinate blocks and which is started by the sychronized oscillation period signal $S_{DS}$. This reference time signal generator is stopped by the output signal of a comparator 55 in that instant when the counted number of a tone frequency counter 54 equals the stored number K1 of a read-only-memory 56. The tone frequency counter 54 is enabled by the enabling signal $S_F$. To prevent that the counter continues counting after reaching the fixed number K1, an AND-gate 73 is provided to which, besides the rectangular signal $S_R$, the inverted wait signal $\overline{S_W}$ is supplied. To open the gate, the inverted read signal $S_L$ generated in the reference time signal generator 57 is supplied to the AND-gate 3. The signals $S_{DS}$, $S_F$, $S_R$, $S_W$ and $\overline{S_L}$ are generated according to the disclosure of pending U.S. Patent application Ser. No. 958,248-Foerst.

The number K2 stored in a read-only-memory 72 is substracted from the output of the pulse counter 26 in a substraction device 47. To display the number zero at correct tone pitch, K2 must equal K1×K3.

Furthermore, a standard calibration is desirable. Preferably the display is calibrated in Cent (100 units per half tone step). In this case K2 must be chosen according to $$K2 = \frac{100}{0.05946} = 1682.$$

The output of the subtraction device 47 is supplied to the absolute value generator 48 which supplies only positive numbers and additionally, at negative input, a polarity sign. The high frequency reference oscillator 53 may include a commercial low-frequency 12-tone-generator 67 and a high frequency voltage controlled oscillator 65 which is phase locked to the generator 67 and a dual divider 64 for the reduction of the high frequency oscillation to tone frequency. The output of the divider 64 is compared to the output of the 12-tone-generator 67 in a phase comparator 63, and the output of this comparator influences the frequency of the voltage controlled oscillator 65 via a control amplifier 66. Dependent upon the selection of the octave, the intermediate outputs of the divider 64 are supplied via an electrical switch as the high frequency reference signal $S_H$.

The task of the commercial low frequency 12-tone oscillator 67 is to fit the period of the counted oscillation to the opening time of the AND-gate 3 proportionally. Therefore, it is composed by the same components as in the corresponding reference pulse counter described in U.S. Pat. No. 4,253,373-Foerst, namely a read-only-memory 61, a comparator 60, a resettable counter 59 and a crystal oscillator 58 as reference frequency generator. For the presetting of the 12 tone frequencies, a decoder 62 is necessary.

The reference time signal generator 57 is known from the U.S. Pat. No. 4,253,373-Foerst. The present invention provides additionally the OR-Gate 69 and the AND-gate 70 for the generation of an interrupted display. This circuit functions that way, that the AND-gate 3 for the counting process is not only opened when the flip-flop 34 for the wait signal is reset by the synchronized oscillation period signal $S_{DS}$ but also when the read period is finished and the inverted read signal $\overline{S_L}$ appears simultaneously with the wait signal $S_W$.

The present invention is, of course, in no way restricted to the specific disclosure of the specification and drawing but also encompasses any modifications within the scope of the appended claims.

What I claim is:

1. A tuning device for musical instruments comprising in combination a high frequency oscillator having a frequency controlled by a tone select switch and an octave select switch and the output $S_H$ of which is supplied to the input of an AND-gate, the output of which is supplied to the display device for the tone pitch and the other input of which is connected to the output of a reference time signal generator which comprises a flip-flop for a wait signal $S_W$ and which is started by the amplitude of the tone via a microphone, an amplifier, a filter, a smoothing device and a Schmitt-trigger, and which is stopped after the counting of a definite number of tone oscillations filtered and converted, said high frequency reference oscillator comprising a low frequency 12-tone generator, which is addressable via a decoder by the tone select switch, a high frequency voltage controlled oscillator for the generation of the output signal $S_H$, a dual divider, and a phase comparator for the comparison of the output signal of said divider to the output signal $S_N$ of said low frequency 12-tone generator, the output signal of said comparator reacting via a control amplifier on the frequency of said high frequency voltage controlled oscillator and the intermediate successively halved output frequencies of said divider as the high frequency reference signal $S_H$ being supplied to said AND-gate via an electronic switch which is controlled by said octave select switch, and an OR-gate as well as an AND-gate which for the repeated enabling of the numbers-display device function so that the flip-flop for the wait signal is additionally reset via said OR-gate by the output of said AND-gate, the inputs of which being the wait signal $S_W$ and the inverted read signal $\overline{S_L}$.

* * * * *